United States Patent [19]

Trinks et al.

[11] 4,448,128

[45] May 15, 1984

[54] HOLLOW EXPLOSIVE BODY

[76] Inventors: Walter Trinks, Bergstrasse 71, D-5340 Bad Honnef; Kurt-Albrecht Köhler, Geislarstrasse 86, D-5300 Bonn 3, Fed. Rep. of Germany

[21] Appl. No.: 408,262

[22] Filed: Jul. 27, 1982

Related U.S. Application Data

[62] Division of Ser. No. 74,550, Sep. 11, 1979.

[30] Foreign Application Priority Data

Sep. 21, 1978 [DE] Fed. Rep. of Germany ..... 2841056

[51] Int. Cl.[3] ..... F42B 11/22

[52] U.S. Cl. ..... 102/476; 102/306

[58] Field of Search ..... 102/475, 476, 306–310

[56] References Cited

U.S. PATENT DOCUMENTS

| | | | |
|---|---|---|---|
| 3,109,373 | 11/1963 | Saffer, Jr. | 102/399 |
| 4,034,673 | 7/1977 | Schneider, Jr. | 102/476 |
| 4,160,415 | 7/1979 | Cole | 102/476 |

*Primary Examiner*—Harold J. Tudor

*Attorney, Agent, or Firm*—Laubscher, Philpitt & Laubscher

[57] ABSTRACT

A hollow explosive body is disclosed including a generally cylindrical outer jacket having a main explosive arranged therein. The hollow explosive body is characterized by a lining which at least partially closes and extends within the jacket to define a chamber. An auxiliary explosive charge is arranged within the chamber. Detonation of the auxiliary explosive charge expands the liner, the main explosive, and the jacket, thereby resulting in a hollow explosive body having a greater caliber.

1 Claim, 3 Drawing Figures

HOLLOW EXPLOSIVE BODY

BACKGROUND OF THE INVENTION

This application is a division of application Ser. No. 74,550 filed Sept. 11, 1979.

The present invention relates to a hollow explosive body to fight armored targets by means of missiles comprising an outer jacket containing the explosive material and closed in part or as a whole at one side by a hollow space lining formed towards the inside.

The hollow charges used mostly at present have a pointed conical cavity provided with a metallic lining and closed by the outer jacket containing the explosive charge. The effect is based on the sharply focussed jet formed during the detonation and extending along the axis of the pointed conical hollow space lining, the jet consisting of a sequence of very quick, but small particles. It is possible to eliminate the strong jet bundling by particular armoring so that the high penetrating effect of the hollow charge shell which is based on the strong bundling of the jet is annulled by disturbance of the jet.

Hollow charge explosive bodies having a less concentrated jet bundling and shorter but broader jets could be interfered but less easily, however and, their capacity of penetration would be less effective. The capacity of penetration could only be improved by enlarging the caliber in case of such hollow charges. An enlarged caliber, however, would be hardly possible for reasons of arms technique.

SUMMARY OF THE INVENTION

It is the object of the invention to provide a hollow explosive body insensitive to a far extent against jet disturbance by the aforementioned armoring and which has a relatively high penetrative effect with a relatively small caliber.

According to the invention, it is provided to fit in or before the hollow space an auxiliary explosive charge so dimensioned that upon its ignition, it causes an explosive deformation expanding the lining and the jacket to a larger caliber.

The hollow cavity of such a hollow explosive body is expanded directly prior to the detonation of the explosive thus imparting to the explosive its final shape. As a result, the real caliber of the hollow explosive body which is larger than the original caliber is only formed upon its firing from a barrel. The hollow space will become a trough having a semi-circular or parabolic cross section. By the ignition of the auxiliary explosive charge inside the cavity, the cavity lining including the explosive material and the outer jacket are expanded thus resulting in a charge having a greater hollow space and outer diameter. To facilitate matters, use should be made of a plastic explosive and of easily deformable materials for the hollow space lining and the jacket, e.g. copper, lead or zinc aluminum either in one or several layers. The deformation of the charge having a diameter determined by the missile caliber, into a hollow charge having a greater diameter is realized in that the effects causing the crater formation with the penetrating projectiles are deliberately utilized by means of the auxiliary explosive charge, which, for instance may consist of an explosive layer on the outward side of a curved cup. Upon the detonation of the auxiliary explosive charge, the cup is accelerated towards the hollow space lining covering the main explosive material to form a crater, while the hollow space lining is deformed and the outer jacket is expanded.

Considering the symmetrical arrangement carefully observed as a rule in hollow charge techniques, and by suitably selecting the dimensions of the plate to be accelerated and its explosive coating as well as the collecting mass consisting of the lining material and the plastic explosive and its envelope, an approximately semi-circular crater is formed with the impact of the plate in the cylindrical block of plastic material, the lining material being uniformly, i.e. axial-symmetrically distributed on the surface of the crater. If this structure is caused to detonate, its effect is that of a hollow charge with the realised enlarged diameter. To this effect, an initial fuse is required which must be ignited with a certain delay after the deformation.

The deformation is suitably initiated by a distance fuse being responsive upon the approximation to a target.

BRIEF DESCRIPTION OF THE FIGURES

Embodiments of the invention will be explained hereinafter by way of examples, with reference to the FIGS.

DETAILED DESCRIPTION

Figure 1:
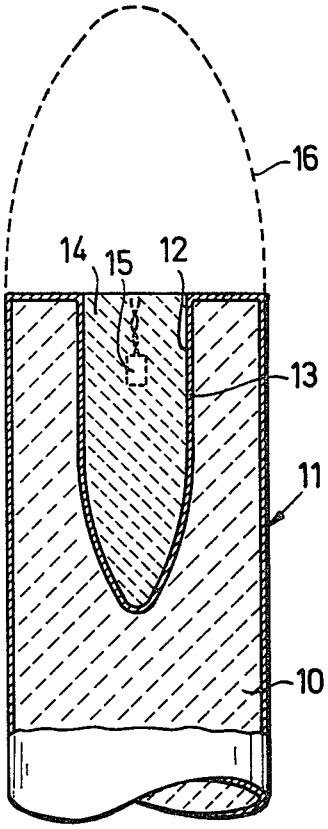
FIG. 1 shows a longitudinal section of a first embodiment of a hollow charge body prior to detonation of the auxiliary explosive charge.

FIG. 1 shows the front end of a hollow charge projectile. The body 10 of plastic explosive material is disposed in a cylindrical jacket 11 made of a soft material easily deformable. At the front end of the explosive body 10, there is the cavity 12 of axial-symmetrical shape, its wall being lined with the metallic hollow space lining 13. The rear side of the hollow space lining 13 is in direct contact with the explosive body 10. The cavity 12 in the instant working example is completely filled with the auxiliary explosive charge 14 in which a fuse 15 is embedded. The cross section of the cavity 12 axially symmetrical relative to the longitudinal axis of the projectile is parabolic.

The hollow charge projectile is closed at its front end with a cap 16 illustrated with a dotted line. The cap is necessary for ballistic reasons.

In the cap 16, a (non-illustrated) distance detector may be housed which is responsive to the hollow charge projectile at a specific distance from the target. The distance detector first excites the fuse 15 for the auxiliary explosive charge, and, with a short delay, subsequently the (non-illustrated) fuse for the main charge 10.

Figure 2:
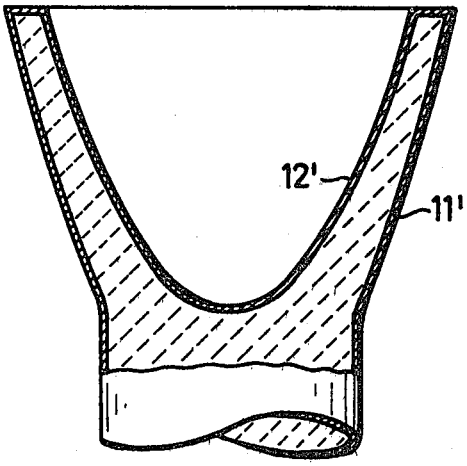
FIG. 2 shows the hollow explosive body of FIG. 1 after the detonation of the auxiliary charge.

FIG. 2 shows the hollow charge body upon ignition of the auxiliary explosive charge. The diameter of the cavity 12' is substantially expanded, and the front end of jacket 11' is enlarged to be funnel-shaped. This is the condition imperative for the detonation of the hollow charge and determining the penetration capacity of the forward jet is generated along the axis of symmetry. As evident from FIG. 2, the explosive ring between the hollow space lining 12' and the jacket 11' has been enlarged at the same time.

Figure 3:
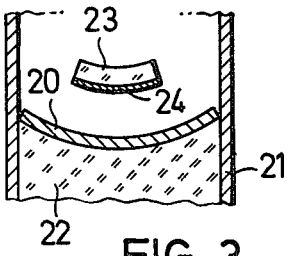
FIG. 3 shows a partial longitudinal section through a second embodiment of the hollow explosive body.

In FIG. 3, the hollow space lining consists of a slightly curved plate 20 covering the explosive mass present in the cylindrical jacket 21. At a distance from the plate 20, there is the auxiliary explosive charge 23 fitted on a metallic ball cup 24. The cup 24 is curved in the same sense as the plate 20 to extend parallel thereto. The auxiliary explosive charge 23 is provided on the side of cup 24 turned away from plate 20.

Upon a detonation of the auxilairy explosive charge 23, the cup 24 is accelerated towards the plate 20 to generate therein a crater-shaped trough, the plate 20 tending to evade laterally. As a result, the plate 20 just like the front end of the jacket 21 becomes funnel-shaped so that the diameter of the hollow explosive body is enlarged at its front end.

The auxiliary explosive charge 23 may be mounted with the cup 24 at a mounting secured to the projecting end of the jacket 21 (but not illustrated).

We claim:

1. A hollow explosive projectile for penetrating an armored target, comprising (a) a hollow cylindrical jacket (21) formed of resilient material and closed at one end;

(b) a body of explosive material (22) arranged within said jacket, said body of explosive material containing an axial recess;

(c) a generally circular concave lining plate (20) arranged within said recess and in contact with said jacket extending continuously across the interior of said jacket, one surface of said plate being in contiguous engagement with said body of explosive material, thereby to enclose said body of explosive material;

(d) an auxiliary charge support plate (24) having a concave configuration corresponding with said lining plate;

(e) means for mounting said support plate in parallel spaced relation from said lining plate; and (f) a body of auxiliary explosive charge material (23) arranged in contiguous relation with the remote surface of said support plate relative to said lining plate, whereby upon ignition of said auxiliary explosive charge material, said support plate is operable to expand said lining plate and said cylindrical jacket radially outwardly, and upon subsequent ignition of said body of explosive material the projectile penetrates the armored target.

* * * * *